United States Patent [19]

Watson

[11] 4,011,418

[45] Mar. 8, 1977

[54] VIBRATION RESPONSIVE SWITCH

[75] Inventor: Jack H. Watson, Los Angeles, Calif.

[73] Assignee: The United States of America as represented by the Secretary of the Navy, Washington, D.C.

[22] Filed: Oct. 18, 1963

[21] Appl. No.: 326,649

Related U.S. Application Data

[62] Division of Ser. No. 78,189, Dec. 23, 1960.

[52] U.S. Cl. ..... 200/61.45 R; 200/DIG. 20

[51] Int. Cl.[2] ..... H01H 35/14

[58] Field of Search ..... 200/61.45, 61.49, 61.53, 200/61.45 R, DIG. 20

[56] References Cited

UNITED STATES PATENTS 2,787,678 4/1957 Burggren ..... 200/61.53

*Primary Examiner*—Richard A. Farley

EXEMPLARY CLAIM

1. A vibration responsive switch comprising a mass, a pair of support structures located on opposite sides of said mass, a taut wire attached to both of said support structures and to said mass, a switch armature mounted on said mass, and a fixed contact located in physical proximity to said armature.

5 Claims, 5 Drawing Figures

INVENTOR
Jack H. Watson

BY

ATTORNEY

INVENTOR
Jack H. Watson

BY

ATTORNEY

VIBRATION RESPONSIVE SWITCH

This application is a division of my copending application Ser. No. 78,189 filed Dec. 23, 1960.

This invention relates to air dropped land mines that are responsive to vehicle influences and more particularly to a vibration responsive switch which may be utilized on a land mine of the type described.

Prior land mines have suffered many disadvantages associated with their planting in enemy territory because of the resulting ease with which they could be detected. Also, many prior land mines rely on contact with an enemy vehicle to detonate them thereby rendering them inoperative when such vehicles merely come in proximity therewith.

Accordingly, it is an object of this invention to provide a new and improved land mine.

A further object of this invention is to provide a new and improved land mine that may be dropped from an aircraft.

It is an additional object of this invention to provide a new and improved influence responsive land mine which may be dropped from an aircraft.

Another object of this invention is to provide a land mine responsive to seismic vibrations and magnetic influences.

A further object of this invention is to provide a new and improved vibration responsive or seismic switch.

Various other objects and advantages will appear from the following description of one embodiment of the invention, and the novel features will be particularly pointed out hereinafter in connection with the appended claims.

The aforementioned objects will be achieved by a novel vibration responsive switch which is connected to a search coil responsive to a magnetic field. The resulting signal detected by the search coil may be fed to special electronic apparatus designed to trigger an explosive train, when the vehicle producing the magnetic field and the seismic vibrations is directly above the mine, thereby knocking out the vehicle.

The unique vibration responsive or seismic switch employed in this mine comprises a free mass which is suspended by a suitable wire. The mass carries an electrical switch contact which vibrates back and forth between a pair of fixed contacts when a moving vehicle is in proximity to the mine. This apparatus is rendered inoperative until the mine vehicle has struck the ground so that the piano wires will not break upon impact.

Reference is now made to the following description taken in connection with the accompanying drawings in which.

In the detailed description of this invention like reference numerals designate like or corresponding parts throughout the several figures.

Figure 1:
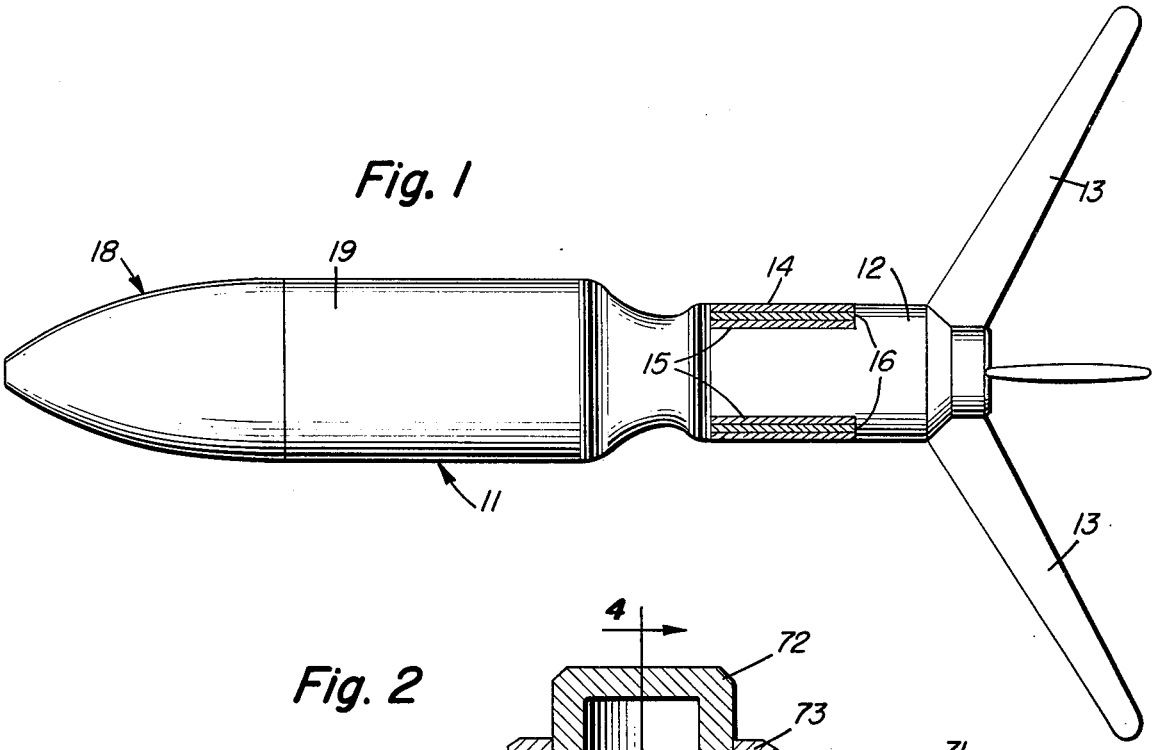
FIG. 1 is an overall view of the entire mine.

Referring now to FIG. 1 of the drawings, there is shown a mine body 11 having a mid or central portion 19 wherein the explosive charge is stored. Fins 13 insure aerodynamic qualities of the mine while it is dropping through the air and are secured to the tapered body portion 12, which is located to the rear of central portion 19. Search coil 16 which detects changes in the local magnetic field is located on the tapered body portion 12 just to the rear of the mid section of the mine. The coil 16 is covered by insulation 14 on the exterior of the mine and a circular shield 15 is in proximity to the interior circumference of the circular pickup coil. Search coil 16 is electrically connected to the nose of fuze portion 18 of the mine by way of suitable leads (not shown).

When the mine vehicle 11 is dropped from the air it will enter the ground with nose portion 18 first. The mine will strike the ground with sufficient force to bury itself in most cases. When a magnetic vehicle moves in proximity to the mine, search coil 16 will detect the resulting change in the earth's magnetic field and a voltage will be generated therein whih is fed to fuze 18. This voltage is utilized as one of the prime influences to actuate the fuze mechanism.

Vibration switch 25 is secured in the forward end of the fuze and is held in place by any suitable means which may be set screws. This vibration or seismic switch is connected electrically to the special electronic apparatus by way of suitable wiring (not shown).

Figure 2:
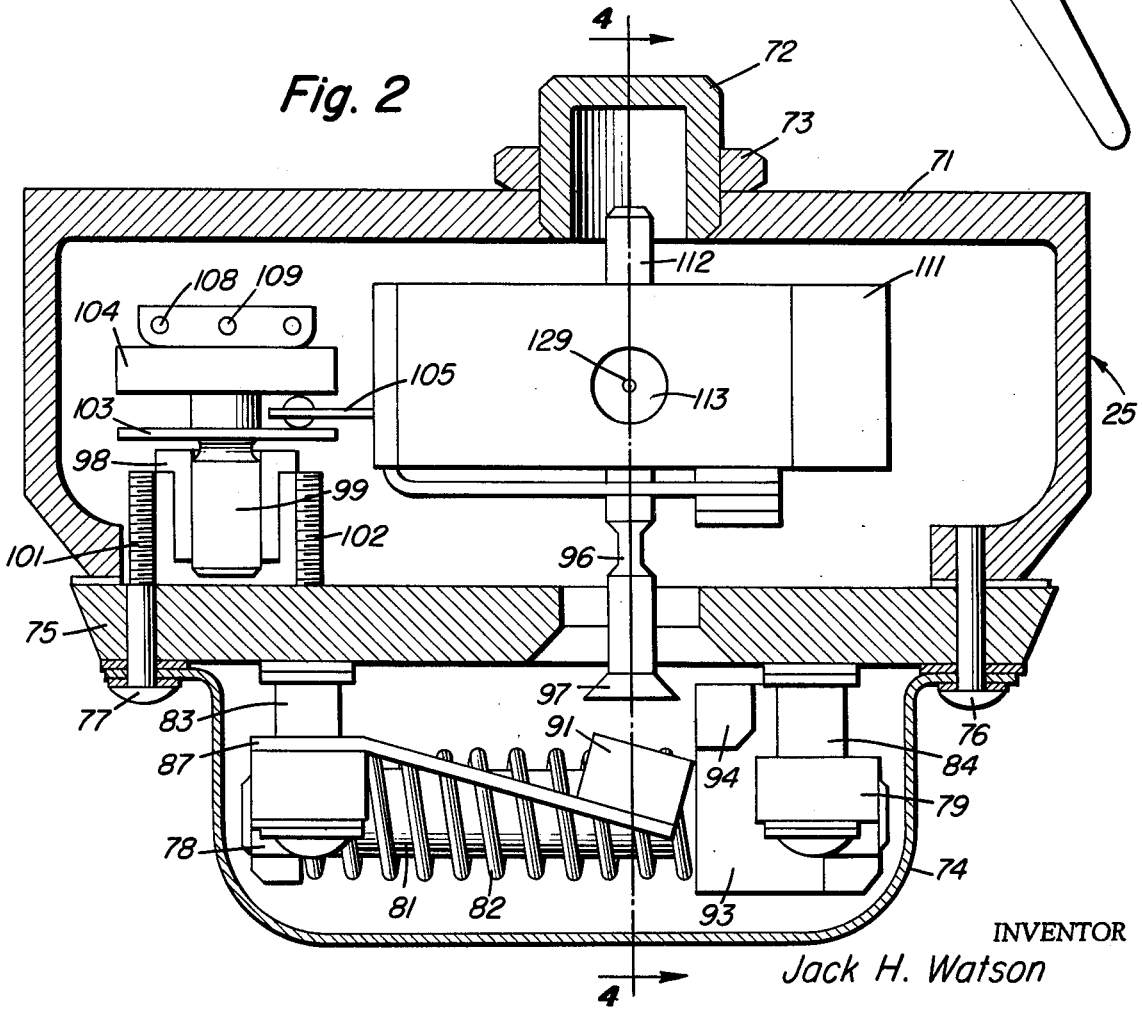
FIG. 2 is a sectional view of the novel seismic switch after the mine has struck the ground.

Referring now to FIG. 2 of the drawings, there is shown a sectional view of the seismic switch 25 after the mine has been dropped into the soil, i.e., when it is to be responsive to vibrations in the earth. The switch has an exterior shell 71 upon which a cover 72 is secured in place by nut 73. This structure is held in place within the fuze in such a manner that cover 72 is facing the special electronic assembly and top 74 is directed toward the front end of the nose portion 18. Shelf 75 is secured between top 74 and exterior shell 71 by screws 76 and 77 which are inserted in appropriate bores. Housings 78 and 79 are secured to shelf 75 by four screws of which two, 83 and 84, are shown in this figure. A shaft 81 carrying a coil spring 82 is located between the housings 78 and 79. A pair of torsion bars, 87, 88 (FIG. 4) is secured to the top of housing 78. Weights 91, 92 are secured to each of the torsion bars 87, 88, respectively. Subsequent to impact of the mine vehicle spring retaining member 93 is forced against housing 79 by coil spring 82.

Figure 4:
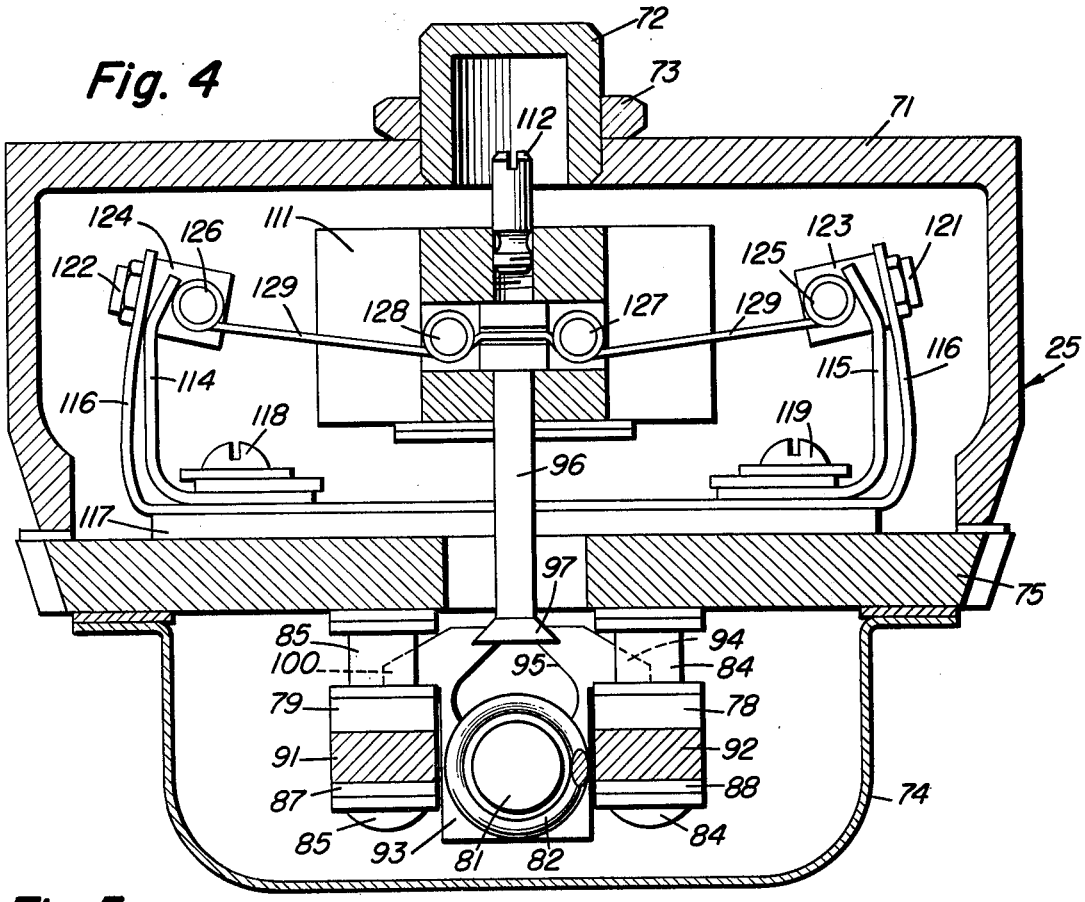
FIG. 4 is a sectional view of the seismic switch taken along lines 4—4 of FIG. 2.

The relative position of these members is best shown in FIG. 4 of the drawings, which is a sectional view of FIG. 2 taken through the lines 4—4. Weights 91 and 92, which are carried by torsion bars 87 and 88, respectively, straddle shaft 81 and spring 82, as do screws 84 and 85. Prior to impact of the switch mechanism, shaft 96 secures free mass 111 in place, since the flange 97 of shaft 96 to which the free mass is secured is maintained within cavity 95 of retaining member 93. In addition, the position of flanges or protruding parts 94 and 100, on either side of retaining member 93, with respect to weights 91 and 92 is to be noted.

Figure 3:
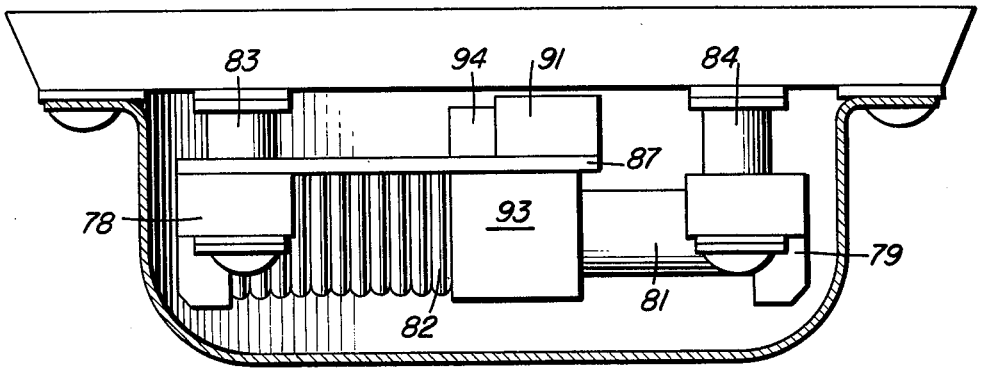
FIG. 3 is a partial sectional view of the seismic switch prior to the time that the mine has struck the ground.

FIG. 3 is a partial view of the lower part of the apparatus shown in FIG. 2 prior to impact of the mine vehicle with the ground. When the seismic switch is in this position, shaft 96 maintains mass 111 in a fixed position since the flange 97 engages the cavity 95 of spring retaining member 93. The flanges 94 and 100 on spring retaining member 93 are secured in place by weights 91 and 92, respectively, which are located on the torsion bars. Accordingly, spring 82 is tightly coiled between member 93 and housing 78.

When the seismic switch is dropped to the ground, the weights 91 and 92 will exert sufficient torque on the torsion bars 87 and 88, respectively, so as to cause the bars to assume the bent position shown in FIG. 2. The weights are forced down sufficiently so that they no longer contact protruding members 94 and 100 of spring retaining member 93. Accordingly, coil spring 82 forces member 93 against housing 79, thereby freeing flange 97 from the cavity 95. Mass 111 is thus permitted to freely respond to seismic vibrations applied to the mine apparatus.

Referring now again to FIG. 2 of the drawings, screws 101 and 102 support a bushing 98 to which a shaft 99 is secured by any appropriate means. The shaft 99 carries a pair of electrical contacts 103 and 104 and is made of some appropriate conducting material so that the two contacts carried thereby are electrically connected together. Electrical terminal board 108 attached to contact 104 electrically couples contacts 103 and 104 to the special electronic apparatus by suitable lead wires (not shown). Armature 105 having a pair of tits is arranged underneath free mass 111 to a terminal 109. The terminal 109 is likewise electrically connected to the special electronic apparatus by way of wires coupled to one of the terminals on board 108.

Figure 5:
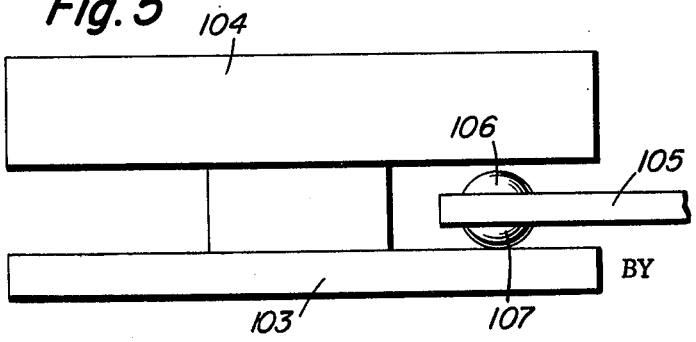
FIG. 5 is a greatly enlarged view of the switch and its associated contacts.

One of the tits carried by armature 105 touches the lower contact 103 while the other tit is spaced from the upper contact 104. This construction is best shown in greatly enlarged form in FIG. 5 wherein the tit 107 touches contact 103 and tit 106 is spaced from contact 104. Thus, an electrical circuit is normally formed between armature 105 and contact 103. The sensitivity of this seismic switch can be varied by adjusting screws 101 and 102 thereby controlling the force with which contact 103 bears on tit 107. It is to be understood that upper contact 104 is not essential to operation of this switch but that it is utilized to insure rapid electrical connections when the free mass is vibrating.

Adjusting screw 112 is carried on weight 111 so as to control the sensitivity thereof. This screw can be reached when cover 72 is removed.

Referring now more specifically to FIG. 4 of the drawing wherein piano wire 129 is shown as extending between wire assemblies 123 and 124 and screws 127 and 128 which are carried on free mass or weight 111. The piano wire communicates with the interior portion of the free mass by means of a bore 113 shown in FIG. 2. Screws 125 and 126 are carried on wire assemblies 123 and 124, respectively, which are secured to opposite arms of leaf spring 116. The central portion of leaf spring 116 is supported on base member 117 and is secured in place by screws 118 and 119. A pair of retaining members 114 and 115 are also held in place by these screws 118 and 119. These retaining members each have a groove therein so that wire assemblies 123 and 124 are fitted therein. These wire assemblies are secured to the leaf springs by way of screws 121 and 122. The retaining members prevent leaf spring 116 from folding into the center when the mine vehicle is dropped on the ground from the air. This spring has a natural frequency of vibration of less than 10 cycles per second and accordingly will not respond to vibrations created by the actuating vehicles. The natural frequency of the free mass is approximately 90 cycles per second. Thus there will be no resonant frequencies of the entire system which will cause very great oscillations of the free mass. When an exciting vibrational force is in the vicinity of this seismic switch, the free mass 111 will oscillate sufficiently however to cause tits 106 and 107 on armature 105 to engage contacts 103 and 104. Thus, piano wire 129 may be considered as a means to freely suspend mass 111 in a plane perpendicular to a component of the transmitted vibrations. Therefore it may be seen that the coil 16 is mounted on the aft end of the mine mechanism and the core 15 is actually the shield which the coil is wrapped around. A condenser may be electrically connected across the coil for tuning purposes. Thus, when a magnetic vehicle is in proximity to the mine which has been buried, the flux sensed by coil 16 will be varied and will generate a voltage of constant frequency across seismic switch 25 which is connected in parallel thereto. With armature 105 resting on contact 103, are shown in the drawings, the voltage generated by search coil 16 cannot be supplied to the first stage of the electronic apparatus. However, when both a magnetic field and a vibration source are in proximity to the mine, contact 105 of vibration switch will oscillate, thereby causing a voltage to be applied to the electronic apparatus when the switch is open.

There has herein been disclosed a new and improved vibration and magnetic field responsive mine. For actuation of the mine it is necessary that both of these influences be present. This invention is accomplished by way of unique seismic or vibration switches which are utilized in a special electronic actuation circuit.

It will understood that various changes in the details, materials, steps and arrangement of parts, which have been herein described and illustrated in order to explain the nature of the invention, may be made by those skilled in the art within the principles and scope of the invention as expressed in the appended claims.

What is claimed is:

1. A vibration responsive switch comprising a mass, a pair of support structures located on opposite sides of said mass, a taut wire attached to both of said support structures and to said mass, a switch armature mounted on said mass, and a fixed contact located in physical proximity to said armature.

2. A normally closed vibration responsive switch comprising a mass, a pair of support structures located on opposite sides of said mass, a taut wire attached to both of said support structures and to said mass, a switch armature mounted on said mass in a plane substantially parallel to said wire, and a first fixed contact normally touching said armature.

3. The switch of claim 2 further including a second fixed contact spaced from said first contact and normally spaced close to said armature, whereby said armature touches both of said contacts repeatedly in successive order when vibrations of sufficient magnitude are transmitted to said mass.

4. An air dropped vibration responsive switch comprising a mass, a leaf spring having a pair of arms and a middle portion, a pair of leaf spring retaining structures located on opposite sides of said mass, a wire attached to said mass, a pair of assemblies each attached to the upper portion of each of said arms, a screw on each of said assemblies for holding said wire taut contacting a respective support structure, releasable means for preventing movement of said mass until sufficient energy is imparted thereto, a switch armature mounted on said mass in a plane substantially parallel to said wire, and a fixed contact normally touching said armature.

5. The switch of claim 4 wherein said releasable means comprises a first shaft having a flange on one end and connected to said mass at the other end, a second shaft mounted in a plane perpendicular to said first shaft, means located on both ends of said second shaft for maintaining it in a relatively fixed position, said shaft carrying a coil spring and a retaining member, said retaining member having a groove engaging the flange of said first shaft and a shoulder extending beyond said second shaft, a pair of torsion bars attached to one of said maintaining means, each of said bars extending on opposite sides of said second shaft, a pair of weights, each carried on the free end of each of said bars, said weights normally engaging the shoulder of said retaining member.

* * * * *